US010502480B2

(12) United States Patent
Dominguez et al.

(10) Patent No.: US 10,502,480 B2
(45) Date of Patent: Dec. 10, 2019

(54) SHELF GASKETS

(71) Applicant: Electrolux Home Products, Inc., Charlotte, NC (US)

(72) Inventors: Salvador Ponce de Leon Dominguez, Anderson, SC (US); Danny Ray Parker, Jr., Piedmont, SC (US); Troy Botts, Williamston, SC (US); Sandeep Kumar, Anderson, SC (US)

(73) Assignee: Electrolux Home Products, Inc., Charlotte, NC (US)

( * ) Notice: Subject to any disclaimer, the term of this patent is extended or adjusted under 35 U.S.C. 154(b) by 0 days.

(21) Appl. No.: 15/765,925

(22) PCT Filed: Oct. 10, 2016

(86) PCT No.: PCT/US2016/056225
§ 371 (c)(1),
(2) Date: Apr. 4, 2018

(87) PCT Pub. No.: WO2017/062934
PCT Pub. Date: Apr. 13, 2017

(65) Prior Publication Data

US 2018/0292125 A1 Oct. 11, 2018

Related U.S. Application Data

(60) Provisional application No. 62/239,488, filed on Oct. 9, 2015.

(51) Int. Cl.

| | |
|---|---|
| ***F25D 25/02*** | (2006.01) |
| ***F25D 23/08*** | (2006.01) |
| ***A47B 96/02*** | (2006.01) |

(52) U.S. Cl.
CPC ..... *F25D 25/02* (2013.01); *F25D 23/087* (2013.01); *A47B 96/021* (2013.01)

(58) Field of Classification Search
CPC ..... F25D 17/045; F25D 17/062; F25D 2317/063; F25D 25/02; F25D 23/087; A47B 96/021
See application file for complete search history.

(56) References Cited

U.S. PATENT DOCUMENTS 2,222,569 A * 11/1940 Newill ..... F25D 25/02 312/408
2,254,635 A * 9/1941 Trigg ..... F25D 23/069 62/329

(Continued)

FOREIGN PATENT DOCUMENTS

DE 19652032 A1 * 6/1998 ..... F25D 17/062
DE 102008063391 A1 * 7/2010 ..... F25D 17/04

(Continued)

OTHER PUBLICATIONS

International Search Report for PCT/US2016/056225, dated Nov. 28, 2016, 3 pages.

*Primary Examiner* — Andrew M Roersma
(74) *Attorney, Agent, or Firm* — Pearne & Gordon LLP

(57) ABSTRACT

A shelf in a cooled compartment (10) has gaskets (32,42) selectively attachable and removable at sides (22,24,26) of the shelf. The gaskets (32,42) are configured to obstruct the flow of air at at least a portion of a gap between the shelf and a wall (14,16,18) of the compartment (10) on the side of the shelf where the gasket is attached.

20 Claims, 3 Drawing Sheets

(56) References Cited

U.S. PATENT DOCUMENTS

| | | | | | |
|---|---|---|---|---|---|
| 2,310,872 | A * | 2/1943 | Rundell | F25D 23/069 | 62/329 |
| 2,412,904 | A * | 12/1946 | Money | F25D 17/045 | 312/296 |
| 2,429,709 | A | 10/1947 | Curiss | | |
| 2,434,117 | A * | 1/1948 | Money | F25D 17/045 | 211/153 |
| 2,645,909 | A * | 7/1953 | Philipp | F25D 17/045 | 62/288 |
| 3,407,016 | A | 10/1968 | Kronenberger | | |
| 3,429,628 | A | 2/1969 | Laszlo | | |
| 3,726,578 | A * | 4/1973 | Armstrong | F25D 17/062 | 312/313 |
| 4,736,997 | A | 4/1988 | Besore et al. | | |
| 4,923,260 | A | 5/1990 | Poulsen | | |
| 5,851,143 | A | 12/1998 | Hamid | | |
| 6,056,382 | A | 5/2000 | Arad | | |
| 6,347,530 | B1 * | 2/2002 | Kim | F25D 17/065 | 62/407 |
| 7,121,104 | B2 | 10/2006 | Howington et al. | | |
| 7,263,856 | B2 | 9/2007 | Choi et al. | | |
| 8,721,014 | B2 * | 5/2014 | Yang | F25D 23/067 | 312/408 |
| 2002/0047506 | A1 | 4/2002 | George | | |
| 2003/0006683 | A1 | 9/2003 | Bienick | | |
| 2005/0127806 | A1 | 6/2005 | Bienick | | |
| 2007/0046160 | A1 | 3/2007 | Egan | | |
| 2015/0127805 | A1 | 5/2015 | Htay et al. | | |

FOREIGN PATENT DOCUMENTS

| | | |
|---|---|---|
| EP | 1271078 | 1/2003 |
| KR | 20090075074 | 7/2009 |
| WO | 9631147 | 10/1996 |

* cited by examiner

SHELF GASKETS

BACKGROUND

1. Field of the Invention

The following description relates generally to compartments containing shelf units with gaskets arranged at openings or gaps between the shelf units and the compartment interiors for the purpose of controlling air flow at the shelf units. In particular, the description concerns such shelf units provided at the fresh food compartments of bottom-mount refrigerators.

2. Related Art

Compartments of various types can be provided with shelf units. These compartments can include, for example, refrigeration appliances such as bottom-mount refrigerators. The control of the flow of air within the compartments at the shelf units can be of importance.

BRIEF SUMMARY OF THE INVENTION

The following presents a simplified summary of the invention in order to provide a basic understanding of some aspects of the invention. The summary does not represent an extensive overview of invention, nor is the summary intended to identify key or critical elements of the invention or delineate the scope of the invention. The sole purpose of the summary is to present certain concepts of the invention in a simplified form as a prelude to the description of the invention that is presented hereinafter.

According to one aspect of the invention, a compartment can include a compartment interior that comprises an interior first side face, an interior second side face and an interior rear face. At least one shelf unit can be supported within the compartment, and the at least one shelf unit can include at least one of a shelf unit first side edge located at the interior first side face, a shelf unit second side edge located at the interior second side face and a shelf unit rear edge located at the interior rear face. At least a portion of at least one of the shelf unit first side edge, the shelf unit second side edge and the shelf unit rear edge can be spaced away from the interior first side face, the interior second side face and the interior rear face, respectively, thereby forming at least one of a first gap between the interior first side face and the at least a portion of the shelf unit first side edge, a second gap between the interior second side face and the at least a portion of the shelf unit second edge and a third gap between the interior rear face and the at least a portion of the shelf unit rear edge. Gaskets can be provided at these gaps. Specifically there can be provided at least one of a first side edge gasket selectively attachable and removable at the shelf unit first side edge and configured to obstruct the flow of air at at least a portion of the first gap, a second side edge gasket selectively attachable and removable at the shelf unit second side edge and configured to obstruct the flow of air at at least a portion of the second gap and a rear edge gasket selectively attachable and removable at the shelf unit rear edge and configured to obstruct the flow of air at at least a portion of the third gap. In this and all the other aspects of the invention described herein, the compartment can comprise a compartment of a refrigeration appliance. The refrigeration appliance can comprise a fresh food compartment of a household refrigerator and the household refrigerator can comprise a bottom-mount refrigerator.

According to another aspect, in a particular instance it can be the shelf unit rear edge of at least one shelf unit that is spaced away from the interior rear face. The rear edge gasket can include a rear edge gasket first portion and a rear edge gasket second portion integral with the rear edge gasket first portion. The rear edge gasket first portion can comprise an attachment that is configured to removably attach the rear edge gasket to the shelf unit rear edge, and the rear edge gasket second portion can be configured to obstruct the flow of air at at least a portion of the third gap.

According to a further aspect, the rear edge gasket first portion can be configured to be snapped onto the shelf unit rear edge to maintain the rear edge gasket in place at the third gap. Alternatively, the rear edge gasket first portion can include a slot into which the shelf unit rear edge is slidably received to maintain the rear edge gasket in place at the third gap.

According to an additional aspect, at least one shelf unit can comprise a plurality of shelves supported at the same height at the compartment interior, each of the plurality of shelves having a respective shelf rear edge that collectively comprise the shelf unit rear edge. In one example embodiment, the one shelf unit can comprise a first shelf that comprises a first shelf rear edge first portion and a first shelf rear edge second portion and a second shelf that comprises a second shelf rear edge first portion and a second shelf rear edge second portion;

According to yet another aspect, a cold air dispensing unit can located at the interior rear face of the compartment between the interior first side face and the interior second side face. The cold air dispensing unit can extend outwardly from the interior rear face of the compartment into the compartment interior to a cold air dispensing unit front face. Each of the first shelf rear edge first portion and the second shelf rear edge first portion can be located immediately adjacent the cold air dispensing unit front face; and each of the first shelf rear edge second portion and the second shelf rear edge second portion can be spaced away from the interior rear face, thereby forming a first shelf rear edge second portion gap and a second shelf rear edge second portion gap;

According to yet a further aspect, a first shelf rear edge second portion gasket can be selectively attachable and removable at the first shelf rear edge second portion and be configured to at least partially obstruct the flow of air at the first shelf rear edge second portion gap when attached at the first shelf rear edge second portion; and a second shelf rear edge second portion gasket can be selectively attachable and removable at the second shelf rear edge second portion and be configured to at least partially obstruct the flow of air at the second shelf rear edge second portion gap when attached at the second shelf rear edge second portion.

According to yet an additional aspect, each of the first shelf rear edge second portion gasket and the second shelf rear edge second portion gasket can slope downwardly from the first shelf rear edge second portion and the second shelf rear edge second portion, respectively, toward the interior rear face.

According to still another aspect, the first shelf rear edge second portion gasket can include a first shelf rear edge second portion gasket first portion and a first shelf rear edge second portion gasket second portion integral with the first shelf rear edge second portion gasket first portion; and the second shelf rear edge second portion gasket can include a second shelf rear edge second portion gasket first portion and a second shelf rear edge second portion gasket second portion integral with the second shelf rear edge second portion gasket first portion. Each of the first shelf rear edge second portion gasket first portion and the second shelf rear edge second portion gasket first portion can comprise an attachment configured to removably attach the first shelf rear edge second portion gasket first portion and the second shelf rear edge second portion gasket first portion to the first shelf rear edge second portion and the second shelf rear edge second portion, respectively, whereby the first shelf rear edge second portion gasket second portion, at least partially, obstructs the flow of air at the first shelf rear edge second portion gap and the second shelf rear edge second portion gasket second portion at least partially obstructs the flow of air at the second shelf rear edge second portion gap.

According to still a further aspect, the first shelf rear edge second portion gasket first portion can be configured to be snapped onto the first shelf rear edge second portion to maintain the first shelf rear edge second portion gasket in place at the first shelf rear edge second portion gap, and the second shelf rear edge second portion gasket first portion can be configured to be snapped onto the second shelf rear edge second portion to maintain the second shelf rear edge second portion gasket in place at the second shelf rear edge second portion gap.

According to still an additional aspect, the first shelf rear edge second portion gasket first portion can include a slot into which the first shelf rear edge second portion is slidably received to maintain the first shelf rear edge second portion gasket in place at the first shelf rear edge second portion gap; and the second shelf rear edge second portion gasket first portion can include a slot into which the second shelf rear edge second portion is slidably received to maintain the second shelf rear edge second portion gasket in place at the second shelf rear edge second portion gap.

BRIEF DESCRIPTION OF THE DRAWINGS

The foregoing and other features and advantages of the present invention will become apparent to those skilled in the art to which the present invention relates upon reading the following description with reference to the accompanying drawings, in which.

DETAILED DESCRIPTION

Figure 1:
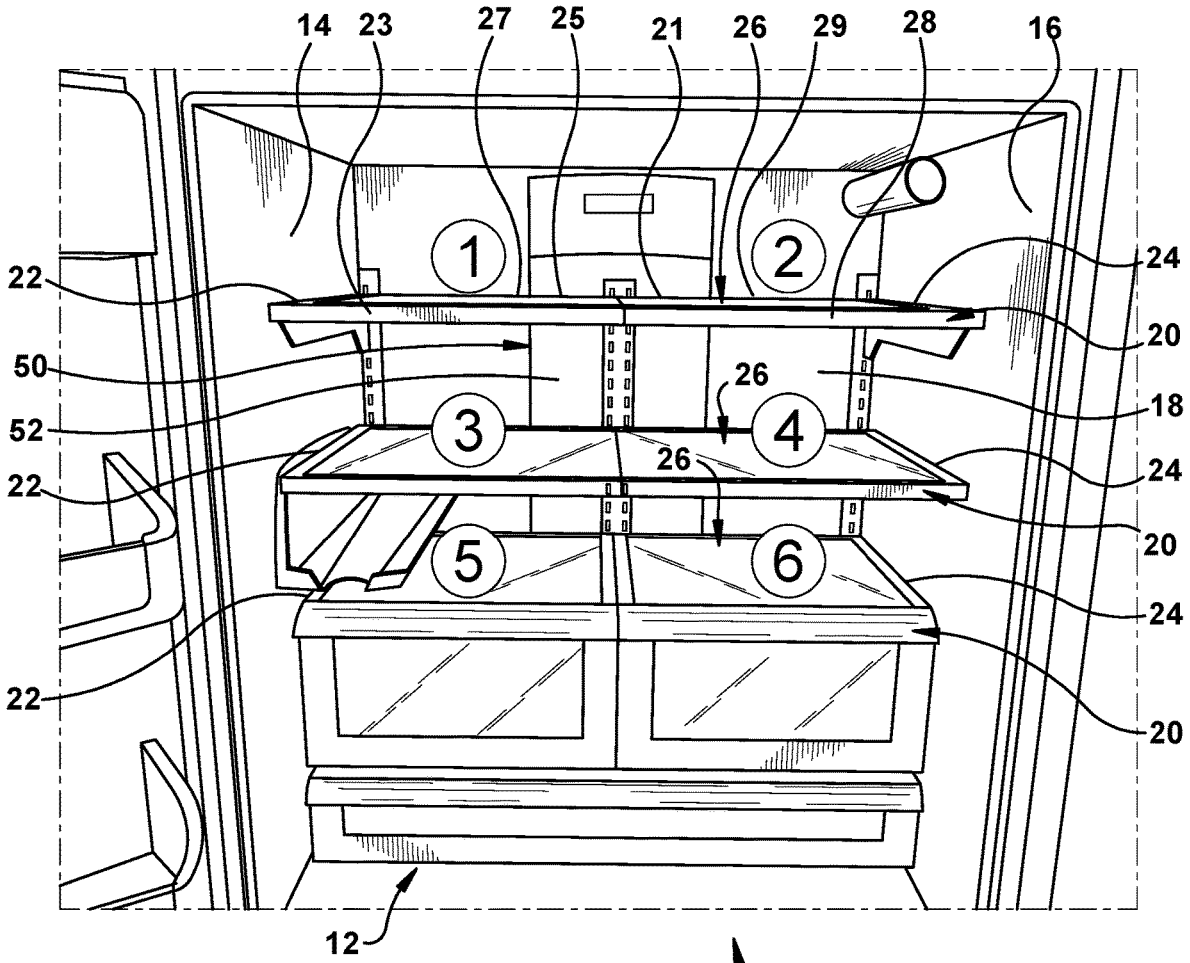
FIG. 1 is a front perspective view of an example embodiment of the invention that comprises an interior of a fresh food compartment of a bottom-mount refrigerator, the shelves of which include shelf gaskets.

The present invention will now be described with reference to the drawings, wherein like reference numerals are used to refer to like elements throughout. It is to be appreciated that the various drawings are not necessarily drawn to scale from one figure to another or within a given figure. Also, the sizes of the components are somewhat arbitrarily drawn in order to facilitate an understanding of the drawings. In the following description, numerous specific details are set forth in order to provide a thorough understanding of the present invention, but it can be possible in certain instances to practice the present invention without those specific details. Additionally, the examples discussed are not intended to be a limit on the invention. For example, one or more aspects of the disclosed examples can be utilized in other examples and even other types of apparatus and devices.

Referring first to FIG. 1, there is illustrated an example embodiment of the present invention comprising a fresh food compartment, indicated generally at 10, of a bottom mount refrigerator. The present invention, however, is not limited to fresh food compartments of bottom-mount refrigerators and has application to other types of compartments provided with shelves. For example, the present invention can be employed at other kinds of refrigeration appliances including the fresh food compartments of household refrigerators other than bottom-mount refrigerators.

The fresh food compartment 10 includes a compartment interior, indicated generally at 12, that comprises an interior first side face 14, an interior second side face 16 and an interior rear face 18. There is at least one shelf unit supported within the fresh food compartment 10 at the compartment interior 12. In FIG. 1 there are three such shelf units, indicated generally at 20, installed at the compartment interior 12. The at least one shelf unit includes at least one of a shelf unit first edge located at the interior first side face 14, a shelf unit second edge located at the interior second side face 16 and a shelf unit rear edge located at the interior rear face 18. In the example of FIG. 1, each shelf unit 20 includes a shelf unit first side edge 22 located at the interior first side face 14, a shelf unit second side edge 24 located at the interior second side face 16 and a shelf unit rear edge, indicated generally at 26, located at the interior rear face 18. At least a portion of at least one of the shelf unit first side edge 22, the shelf unit second side edge 24 and the shelf unit rear edge 26 is spaced away from the interior first side face 14, the interior second side face 16 and the interior rear face 18, respectively, thereby forming at least one of a first gap between the interior first side face 14 and the at least a portion of the shelf unit first side edge 22, a second gap between the interior second side face 16 and the at least a portion of the shelf unit second side edge 24 and a third gap between the interior rear face 18 and the at least a portion of the shelf unit rear edge 26.

Figure 2:
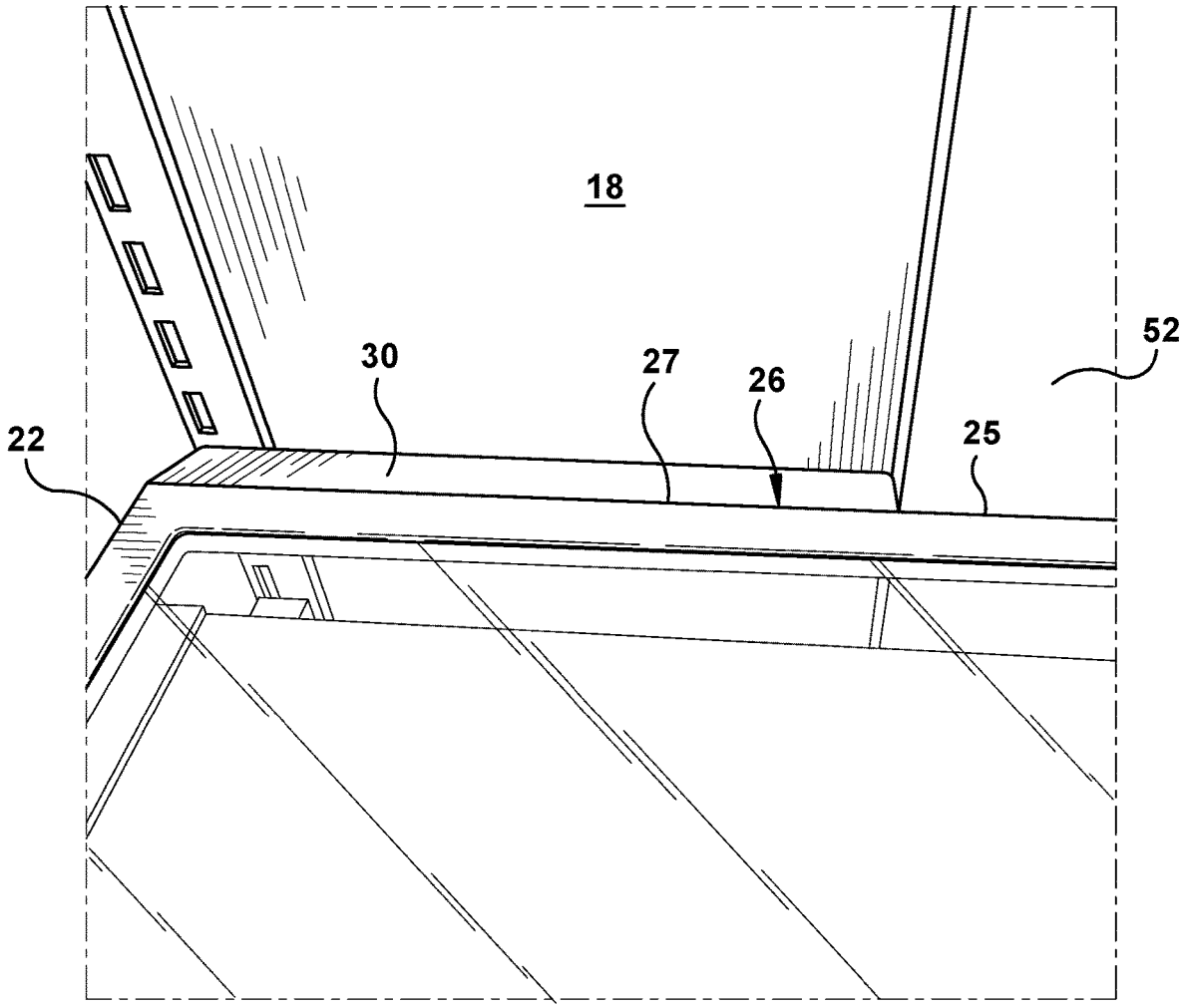
FIG. 2 is a perspective view of a portion of the interior of the fresh food compartment of FIG. 1 that shows a shelf gasket installed at a shelf within the fresh food compartment.

At least one of a first side edge gasket can be selectively attachable and removable at the shelf unit first side edge 22 and configured to obstruct the flow of air at at least a portion of the first gap when attached at the shelf unit first side edge 22; a second side edge gasket can be selectively attachable and removable at the shelf unit second side edge 24 and configured to obstruct the flow of air at at least a portion of the second gap when attached at the shelf unit second side edge 24; and, in the example shown in the drawings, a rear edge gasket is selectively attachable and removable at the shelf unit rear edge 26 and is configured to obstruct the flow of air at at least a portion of the third gap when attached at the shelf unit rear edge 26. Referring to FIG. 2, it is illustrated there that the shelf unit rear edge 26 of a shelf unit 20 is spaced away from the interior rear face 18 and a rear edge gasket 30 is selectively attachable and removable at the shelf unit rear edge 26 and configured to obstruct the flow of air at at least a portion of a third gap between the interior rear face 18 and the at least a portion of the shelf unit rear edge 26 when attached at the shelf unit rear edge 26.

Figure 3:
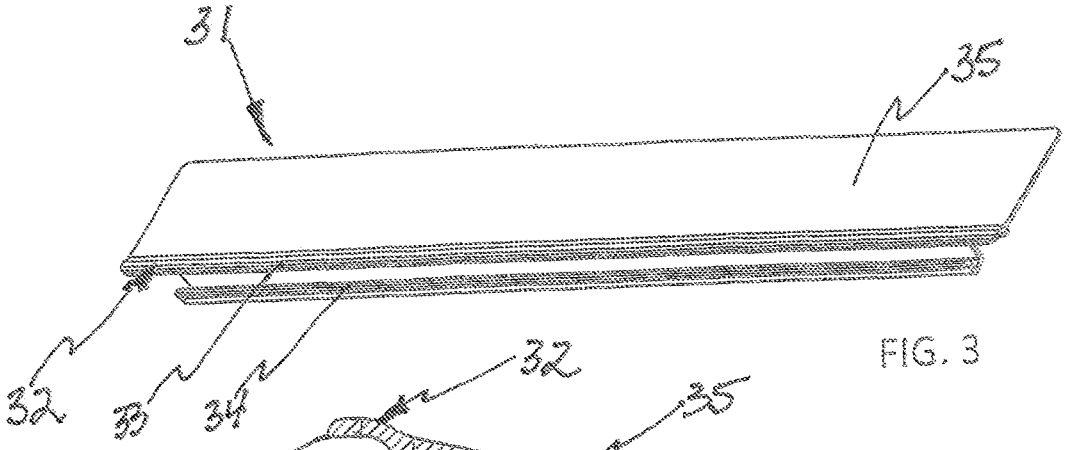
FIG. 3 is perspective view of a first example of a shelf gasket.
Figure 4:
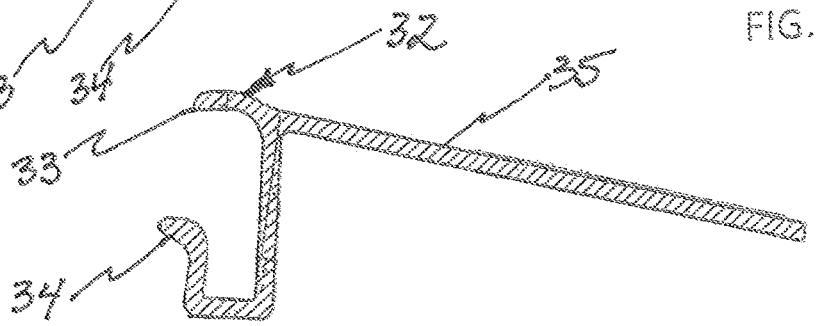
FIG. 4 is a sectional view of FIG. 3.

A first example of the rear edge gasket is shown in FIGS. 3 and 4. In that first example, a first rear edge gasket, indicated generally at 31, includes a first rear edge gasket first portion, indicated generally at 32, and a first rear edge gasket second portion 35 that is integral with the first rear edge gasket first portion 32. The first rear edge gasket first portion 32 comprises an attachment that is configured to removably attach the first rear edge gasket 31 to the shelf unit rear edge 26 and the first rear edge gasket second portion 35 is configured to obstruct the flow of air at at least a portion of the third gap. The first rear edge gasket first portion 32 is configured to be snapped onto the shelf unit rear edge 26 to maintain the first rear edge gasket 31 in place at the third gap. Specifically, the first rear edge gasket first portion 32 includes a gasket upper lip 33 and a gasket lower lip 34. The shelf unit rear edge 26 can be provide with a groove into which the gasket lower lip is inserted and the gasket upper lip 33 is then snapped on to an upper surface of the shelf unit rear edge 26.

Figure 5:
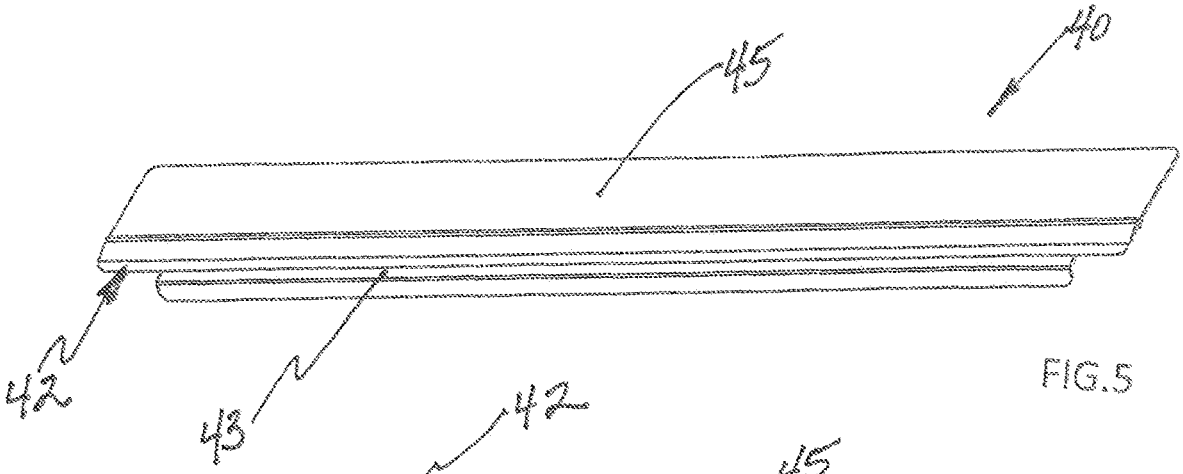
FIG. 5 is a perspective view of a second example of a shelf-gasket.
Figure 6:
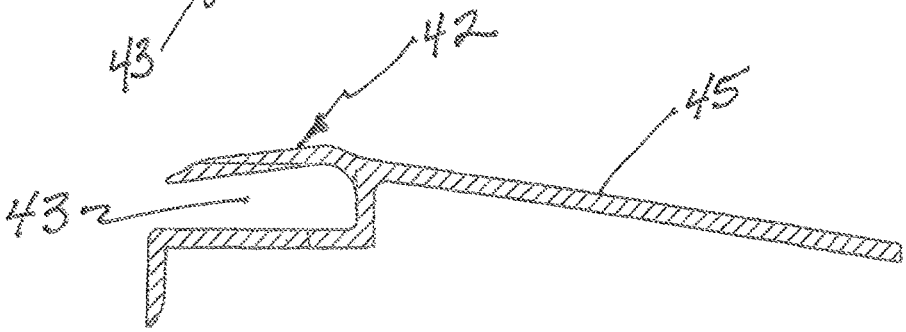
FIG. 6 is a sectional view of FIG. 5.

A second example of the rear edge gasket is shown in FIGS. 5 and 6. In that second example, a second rear edge gasket, indicated generally at 40, includes a second rear edge gasket first portion, indicated generally at 42, and a second rear edge gasket second portion 45 that is integral with the second rear edge gasket first portion 42. The second rear edge gasket first portion 42 comprises an attachment that is configured to removably attach the second rear edge gasket 40 to the shelf unit rear edge 26 and the second rear edge gasket second portion 45 is configured to obstruct the flow of air at at least a portion of the third gap. The second rear edge gasket first portion 42 includes a slot 43 into which the shelf unit rear edge 26 is slidably received to maintain the second rear edge gasket 40 in place at the third gap. Specifically, the shelf unit rear edge 26 can be provide with an extension which is inserted into the slot 43.

In the example illustrated in the drawings, a cold air dispensing unit, indicated generally at 50, is located at the interior rear face 18 between the interior first side face 14 and the interior second side face 16. The cold air dispensing unit 50 extends outwardly from the interior rear face 18 into the compartment interior 12 to a cold air dispensing unit front face 52.

In the example of the drawings, at least one of the shelf units 20 comprises a plurality of shelves that are supported at the same height at the compartment interior 12, each shelf having a respective shelf rear edge that collectively comprise the shelf unit rear edge 26. Thus, at least one of the shelf units 20 comprises a first shelf 23 and a second shelf 28. The first shelf 23 includes a first shelf rear edge first portion 25 that is located opposite the cold air dispensing unit front face 52 and a first shelf rear edge second portion 27 that is located opposite the interior rear face 18. The second shelf 28 includes a second shelf rear edge first portion 21 that is located opposite the cold air dispensing unit front face 52 and a second shelf rear edge second portion 29 that is located opposite the interior rear face 18.

Each of the first shelf rear edge first portion 25 and the second shelf rear edge first portion 21 is located immediately adjacent the cold air dispensing unit front face 52. And each of the first shelf rear edge second portion 27 and the second shelf rear edge second portion 29 is spaced away from the interior rear face 18 thereby forming a first shelf rear edge second portion gap and a second shelf rear edge second portion gap. A first shelf rear edge second portion gasket is selectively attachable and removable at the first shelf rear edge second portion and is configured to at least partially obstruct the flow of air at the first shelf rear edge second portion gap when attached at the first shelf rear edge second portion; and a second shelf rear edge second portion gasket is selectively attachable and removable at the second shelf rear edge second portion and is configured to at least partially obstruct the flow of air at the second shelf rear edge second portion gap when attached at the second shelf rear edge second portion. Both the first shelf rear edge second portion gasket and the second shelf rear edge second portion gasket can be like either of the first rear edge gasket 31 or the second rear edge gasket 40. Thus, in FIG. 2, the rear edge gasket 30 comprises the first shelf rear edge second portion gasket, and as can be seen in FIG. 2, the first shelf rear edge second portion gasket slopes downwardly from the first shelf rear edge second portion toward the interior rear face 18. Similarly, although not shown, the second shelf rear edge second portion gasket can slope downwardly from the second shelf rear edge second portion toward the interior rear face 18. The downward slope of the gasket can be also seen in the sectional views of FIGS. 4 and 6 (i.e., sloped angle of items 35 and 45). The downward slope can enable the gasket to be hidden by the shelf structure (e.g., extending below the planar shelf support surface) so that the gasket is generally invisible or otherwise difficult to see by a user that is looking into the refrigerator cabinet.

It can be the case, particularly when a large number of items are stored at a shelf unit 20, that cold air dispensed at the cold air dispensing unit 50 will tend to flow preferentially through the gaps that can be present at the rear edge of the shelf unit 20 rather than across the shelf unit 20, thereby resulting in the inadequate cooling of the items stored at the shelf unit 20 in the areas of 1, 2, 3, 4, 5 and 6 shown in FIG. 1. The difficulty can be exacerbated if the control unit for controlling the dispensing of cold air from the cold air dispensing unit 50 is located at the cold air dispensing unit. In that case, the cold air flowing through the gaps will provide an indication to the control unit that the temperature in the fresh food compartment 10 is at an appropriate level when, in fact, little cold air has reached many of the items stored at the shelf unit 20. However, with the first shelf rear edge second portion gasket and the second shelf rear edge second portion gasket in place at the first shelf 23 and the second shelf 28 of a shelf unit 20, cold air from the cold air dispensing unit 50 is obstructed from flowing down the first shelf rear edge second portion 27 and the second shelf rear edge second portion 29. As a result, more cold air will flow across the shelf unit 20 so that the items stored in the areas 1, 2, 3, 4, 5 and 6 will be adequately cooled.

The invention has been described herein above using specific examples; however, it will be understood by those skilled in the art that various alternatives may be used and equivalents may be substituted for elements or steps described herein without deviating from the scope of the invention. Modifications may be necessary to adapt the invention to a particular situation or to a particular need without departing from the scope of the invention. It is intended that the invention not be limited to the particular implementation described herein, but that the claims be given their broadest interpretation to cover all embodiments, literal or equivalent, covered thereby.

What is claimed is:

1. A compartment including a compartment interior comprising an interior first side face, an interior second side face and an interior rear face:

at least one shelf unit supported within the compartment, the at least one shelf unit including at least one of a shelf unit first side edge located at the interior first side face, a shelf unit second side edge located at the interior second side face, and a shelf unit rear edge located at the interior rear face, at least a portion of at least one of the shelf unit first side edge, the shelf unit second side edge and the shelf unit rear edge being spaced away from the interior first side face, the interior second side face and the interior rear face, respectively, thereby forming at least one of a first gap between the interior first side face and the at least a portion of the shelf unit first side edge, a second gap between the interior second side face and the at least a portion of the shelf unit second edge, and a third gap between the interior rear face and the at least a portion of the shelf unit rear edge; and at least one of a first side edge gasket selectively attachable and removable at the shelf unit first side edge and configured to obstruct the flow of air at at least a portion of the first gap when attached at the shelf unit first side edge, a second side edge gasket selectively attachable and removable at the shelf unit second side edge and configured to obstruct the flow of air at at least a portion of the second gap when attached at the shelf unit second side edge, and a rear edge gasket selectively attachable and removable at the shelf unit rear edge and configured to obstruct the flow of air at at least a portion of the third gap when attached at the shelf unit rear edge, wherein the first side edge gasket, the second side edge gasket, and the rear edge gasket each comprises:

a main body having a side member, and upper and lower members that extend from the side member to define a channel therebetween, the channel being configured to receive an associated edge of the at least one shelf unit, and a seal portion that is formed integrally with the main body and is cantilevered outwards from the main body, the seal portion extending from an upper portion of the main body in a straight, downward direction away from the shelf unit.

2. The compartment of claim 1 wherein the compartment comprises a compartment of a refrigeration appliance.

3. The compartment of claim 2 wherein the compartment of the refrigeration appliance is a fresh food compartment of a household refrigerator.

4. The compartment of claim 3 wherein the fresh food compartment of the household refrigerator comprises the fresh food compartment of a bottom-mount refrigerator.

5. The compartment of claim 4 wherein:

the shelf unit rear edge of the at least one shelf unit is spaced away from the interior rear face; and the rear edge gasket includes a rear edge gasket first portion and a rear edge gasket second portion integral with the rear edge gasket first portion, the rear edge gasket first portion comprises an attachment configured to removably attach the rear edge gasket to the shelf unit rear edge, and the rear edge gasket second portion is configured to obstruct the flow of air at at least a portion of the third gap.

6. The compartment of claim 5 wherein the rear edge gasket first portion is configured to be snapped onto the shelf unit rear edge to maintain the rear edge gasket in place at the third gap.

7. The compartment of claim 5 wherein the rear edge gasket first portion includes a slot into which the shelf unit rear edge is slidably received to maintain the rear edge gasket in place at the third gap.

8. The compartment of claim 4 wherein the at least one shelf unit comprises a plurality of shelves supported at the same height at the compartment interior, each of the plurality of shelves having a respective shelf rear edge that collectively comprise the shelf unit rear edge.

9. The compartment of claim 8 wherein:

the plurality of shelves comprises a first shelf comprising a first shelf rear edge first portion and a first shelf rear edge second portion and a second shelf comprising a second shelf rear edge first portion and a second shelf rear edge second portion;

a cold air dispensing unit is located at the interior rear face of the compartment between the interior first side face and the interior second side face and extends outwardly from the interior rear face into the compartment interior to a cold air dispensing unit front face, each of the first shelf rear edge first portion and the second shelf rear edge first portion being located immediately adjacent the cold air dispensing unit front face;

each of the first shelf rear edge second portion and the second shelf rear edge second portion is spaced away from the interior rear face thereby forming a first shelf rear edge second portion gap and a second shelf rear edge second portion gap;

a first shelf rear edge second portion gasket is selectively attachable and removable at the first shelf rear edge second portion and is configured to at least partially obstruct the flow of air at the first shelf rear edge second portion gap when attached at the first shelf rear edge second portion; and a second shelf rear edge second portion gasket is selectively attachable and removable at the second shelf rear edge second portion and is configured to at least partially obstruct the flow of air at the second shelf rear edge second portion gap when attached at the second shelf rear edge second portion.

10. The compartment of claim 9 wherein each of the first shelf rear edge second portion gasket and the second shelf rear edge second portion gasket slopes downwardly from the first shelf rear edge second portion and the second shelf rear edge second portion, respectively, toward the interior rear face.

11. The compartment of claim 9 wherein:

the first shelf rear edge second portion gasket includes a first shelf rear edge second portion gasket first portion and a first shelf rear edge second portion gasket second portion integral with the first shelf rear edge second portion gasket first portion;

the second shelf rear edge second portion gasket includes a second shelf rear edge second portion gasket first portion and a second shelf rear edge second portion gasket second portion integral with the second shelf rear edge second portion gasket first portion; and each of the first shelf rear edge second portion gasket first portion and the second shelf rear edge second portion gasket first portion comprises an attachment configured to removably attach the first shelf rear edge second portion gasket first portion and the second shelf rear edge second portion gasket first portion to the first shelf rear edge second portion and the second shelf rear edge second portion, respectively, whereby the first shelf rear edge second portion gasket second portion at least partially obstructs the flow of air at the first shelf rear edge second portion gap and the second shelf rear edge second portion gasket second portion at least partially obstructs the flow of air at the second shelf rear edge second portion gap.

12. The compartment of claim 11 wherein the first shelf rear edge second portion gasket first portion is configured to be snapped onto the first shelf rear edge second portion to maintain the first shelf rear edge second portion gasket in place at the first shelf rear edge second portion gap and the second shelf rear edge second portion gasket first portion is configured to be snapped onto the second shelf rear edge second portion to maintain the second shelf rear edge second portion gasket in place at the second shelf rear edge second portion gap.

13. The compartment of claim 11 wherein the first shelf rear edge second portion gasket first portion includes a slot into which the first shelf rear edge second portion is slidably received to maintain the first shelf rear edge second portion gasket in place at the first shelf rear edge second portion gap and the second shelf rear edge second portion gasket first portion includes a slot into which the second shelf rear edge second portion is slidably received to maintain the second shelf rear edge second portion gasket in place at the second shelf rear edge second portion gap.

14. The compartment of claim 1, wherein the upper and lower members of the main body are integrally formed with the side member of the main body.

15. The compartment of claim 14, wherein the seal portion of the first side edge gasket extends away from the shelf unit toward the interior first side face of the compartment interior, the seal portion of the second side edge gasket extends away from the shelf unit toward the interior second side face of the compartment interior, and the seal portion of the rear edge gasket extends away from the shelf unit toward the interior rear face of the compartment interior.

16. The compartment of claim 15, wherein the shelf unit includes a planar support surface for supporting food items thereon that extends along a support plane, and the seal portion of the gasket extends oblique to the support plane.

17. The compartment of claim 16, wherein the compartment includes the first side edge gasket, the second side edge gasket, and the rear gasket.

18. A shelf assembly for a compartment interior, the shelf assembly comprising:

a shelf unit including a plurality of edges; and a gasket removably attached to an edge of the plurality of edges, wherein the gasket includes:

a main body having a side member and upper and lower members that extend from the side member to define a channel therebetween, the channel being configured to receive the edge of the shelf unit, and a seal portion that is formed integrally with the main body and is cantilevered outwards from the main body, the seal portion extending from an upper portion of the main body in a straight, downward direction away from the edge of the shelf unit.

19. The shelf assembly of claim 18, wherein the upper and lower members of the main body are integrally formed with the side member of the main body.

20. The shelf assembly of claim 19, wherein the shelf unit includes a planar support surface for supporting food items thereon that extends along a support plane, and the seal portion of the gasket extends oblique to the support plane.

* * * * *